United States Patent [19]

Hoffmann

[11] Patent Number: 4,604,876

[45] Date of Patent: Aug. 12, 1986

[54] IMITATION GEM

[76] Inventor: Reinhold Hoffmann,
Neue-Bruch-Strasse 2a, 7505
Ettlingen, Fed. Rep. of Germany

[21] Appl. No.: 637,975

[22] Filed: Aug. 6, 1984

[51] Int. Cl.[4] ..... A44C 17/00

[52] U.S. Cl. ..... 63/32; 428/15; 501/86

[58] Field of Search ..... 63/32; 428/15, 912.2; 501/86

[56] References Cited

U.S. PATENT DOCUMENTS

| | | | |
|---|---|---|---|
| 888,346 | 5/1908 | McDearmon | 63/32 |
| 1,548,646 | 8/1925 | Akeson | 63/32 UX |
| 2,270,270 | 1/1942 | Clare | 63/32 |
| 2,354,067 | 7/1944 | Schmalz | 63/32 |
| 2,699,706 | 1/1955 | Boone | 63/32 X |

FOREIGN PATENT DOCUMENTS

| | | | |
|---|---|---|---|
| 1234080 | 2/1967 | Fed. Rep. of Germany | 63/32 |

*Primary Examiner*—F. Barry Shay
*Attorney, Agent, or Firm*—Klaus J. Bach

[57] ABSTRACT

An imitation gem consisting of a semi shell of a transparent plastic material with concave inner and convex outer surfaces has light reflecting and light refracting facets formed on both its inner concave and outer convex surfaces. The open end of the semi shell is closed by a cover which is also provided with facets so as to further improve light reflection and refraction.

4 Claims, 3 Drawing Figures

IMITATION GEM

BACKGROUND OF THE INVENTION

The invention relates to fashion jewelry, especially to an imitation gem having light refracting and ligh reflecting faceted surfaces.

Such imitation gems, developed by imitation of chandelier glasses, were formerly made of glass and recently of transparent plastic materials. Chandelier glasses have iridescent coatings which are made, for example, by applying to the glass silver sulfuric resinate in solution with certain additives and then baking the glass. The iridescent coatings so produced are semi-transparent mirrors which increase the effects of light reflection and refraction on the surfaces of the glasses at the interface of glass and air.

In order to obtain as many iridescent surfaces as possible, a chandelier consists of glass sections arranged at a multitude of angles relative to one another similar to the surface cut of a diamond. In the manufacture of imitation gems, it has been attempted to imitate these geometric shapes, that is, it has been tried to provide the gems with many surfaces arranged at angles relative to one another so as to provide for certain reflection characteristics. It has been found, however, that such reflection alone cannot generate the effects of iridescence of the original chandelier glasses.

In imitation gems which have one particular display side, the reflection capabilities have been improved by applying light reflecting metal coatings to the back surfaces which are also disposed at various angles.

It is the principal object of the present invention to provide an imitation gem which reflects the light to a large degree in highly concentrated rays but also in refracted form.

High reflection and refraction of light rays on an imitation gem are obtained by forming the gem of a transparent semi shell with a cover mounted thereon and with facets formed on the concave inner and convex outer surfaces of the shell and on the cover.

Such a gem body has faceted surface areas not only on the outside as it has been known but it also has inner surface areas with facets formed thereon. It may consist of two identical half shells, each of which is faceted on its outer and on its inner surfaces. This results in a large number of facets which all are exposed to air, causing reflection of the light at all interfaces of the transparent body and air that is at the outer as well as inner surfaces of the shell. The large number of facets provides for a large number of mirror surfaces which reflect the light at their interface with air and which refract the light rays which pass through the shell walls. As a result, the imitation gem according to the invention appears quite sparkling. This effect can be even further pronounced if the inner surfaces of the exposed side of the shell are provided with a light reflecting metal coating. If the metal coating is made to be so thin that it is semitransparent for light, light rays will pass through the metal coating into the interior of the imitation gem. If then the inner surface of the other semi shell is also provided with facets and with a reflective metal coating which is preferably also semitransparent, the imitation gem will reflect, refract and pass light rays entering from the front but also from the back side. Such imitation gems may be used in the manufacture of sparkling fashion jewelry, especially highly attractive sparkling earrings and other pendants can be created.

Preferably, the facets on the inner concave and the outer convex surfaces of the semi shell are similar but the semi shells are angularly displaced with respect to one another by half the width of the facets so as to provide an even larger number of prismatic light refracting surfaces which are disposed at an angle to one another.

However, the inner and outer facets may be displaced relative to one another by less than half their diameter, for example, by one fourth of their diameter.

If it is desired to obtain a certain orientation of the reflected light, the curvature of the shells may be selected to be aspherical or otherwise shaped as desired. For economical manufacture, however, it is preferable if both semi shells are identical in shape and consist of transparent plastic material.

In place of interconnecting two semispherical shells, it is possible to mount a backplate on a semi shell which backplate is also preferably provided with facets. Such an arrangement is especially advantageous if the imitation gem is intended for use in clothing jewelry but it may also be used for earrings or pendants if the gem is to be relatively flat. A gem formed in this manner also has the effects of iridescence described earlier mainly, however, generated by the facets of the curved semi shell on which the backplate is mounted.

SHORT DESCRIPTION OF THE DRAWING

DESCRIPTION OF A PREFERRED EMBODIMENT

Figure 1:
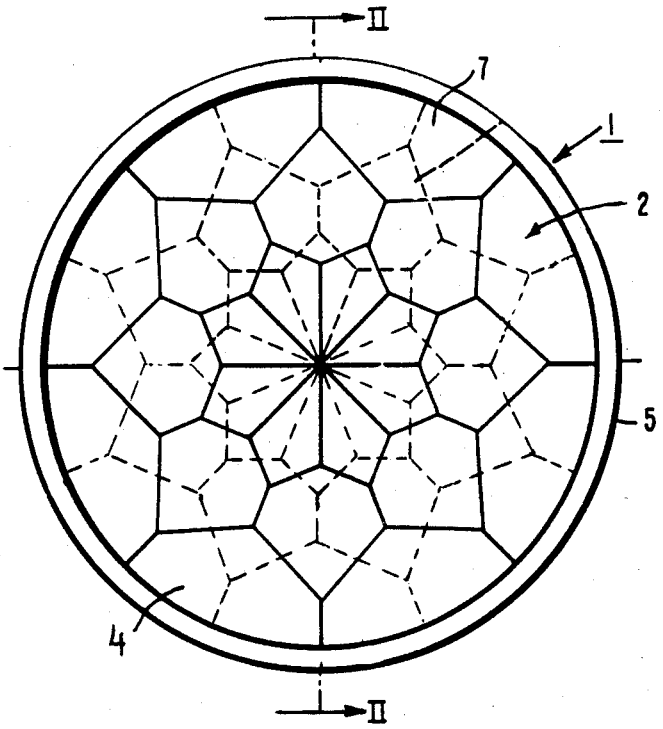
FIG. 1 is a view into the interior of a semi shell showing the inner facets.
Figure 2:
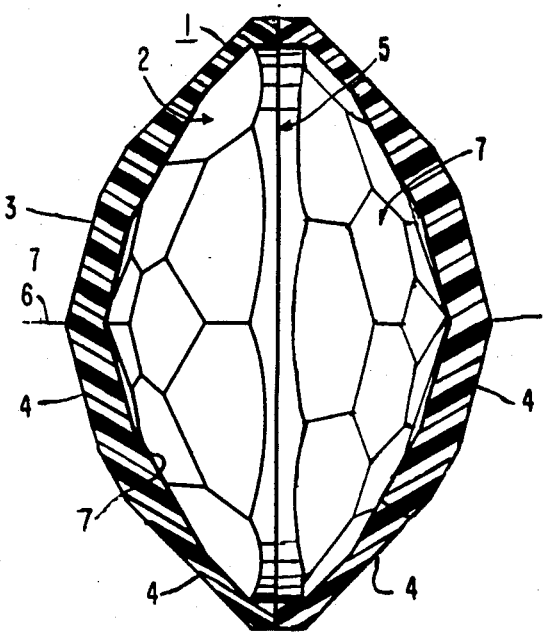
FIG. 2 is a cross-sectional view along line II—II of FIG. 1.

FIGS. 1 and 2 show schematically a semi shell 1 which is injection molded from a transparent plastic material. The shell 1 has an inner generally curved surface 2 and an outer generally curved surface 3 both of which are provided with a multitude of facets 4. The circumferential edge 5 of the semi shell 1 is flat and extends in a plane normal to the axis of the shell 1. This easily permits to provide a cover by combining two semi shells 1 and cementing them together, thereby providing a complete imitation gem. One or both of the inner curved surfaces 2 may be provided with a semi-transparent mirror-like metal coating.

The multitude of facets on the inner and outer surfaces 2 and 3 provide for attractively appearing light reflections wherein light may be separated by the prismatic structures into its spectral colors and reflected in beams by the mirror-like metal coatings.

Figure 3:
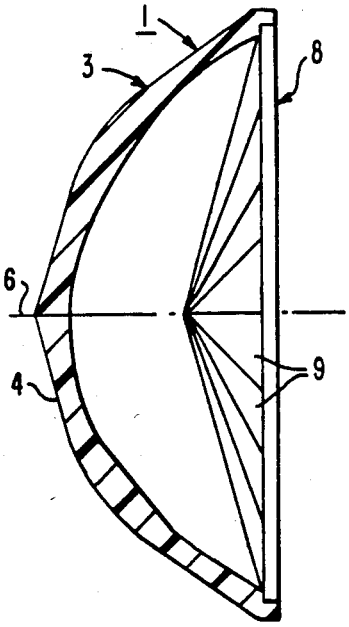
FIG. 3 shows a semi shell with a flat bottom plate.

The inner facets 7 and the outer facets 4 are preferably not parallel but displaced relative to one another. Instead of mounting two semi shells 1 together along their circumferential edge 5, a flat plate 8 may be mounted on a semi shell 1 to provide a relatively flat gem as shown in FIG. 3. The flat cover plate 8 preferably has a centrally elevated essentially conical surface which is also provided with facets 9 that extend roof-like from the center of the plate.

I claim:

1. An imitation gem having light reflecting and light refracting facets formed thereon, said gem comprising two semi-shells mounted together and formed of transparent material, each with an essentially concave inner surface and an essentially convex outer surface both provided with a multitude of facets, said semi-shells having their concave inner surfaces spaced from one another and provided with a semitransparent light reflecting coating, said semi-shells being identical in shape and arrangement of facets and being angularly displaced with respect to each other by a distance of from one fourth to one half of a facet width.

2. A gem according to claim 1, wherein said two semi shells are angularly displaced by half a facet width.

3. A gem according to claim 1, wherein said two semi shells are angularly displaced by about one fourth of a facet width.

4. An imitation gem comprising a semi shell formed of transparent material with an essentially concave inner surface and an essentially convex outer surface, both of said inner and outer surfaces being provided with a multitude of facets, a semitransparent, light reflecting coating disposed on said concave faceted inner surface of said semi shell and a cover mounted on said semi shell, said cover having an essentially conical roof-like, inwardly converging inner surface spaced from the concave faceted inner surface of said semi shell, said conical inner surface having facets formed thereon and being coated with a light-reflecting material.

* * * * *